US009988874B2

(12) United States Patent
James

(10) Patent No.: US 9,988,874 B2
(45) Date of Patent: Jun. 5, 2018

(54) DIAMOND SWITCHING DEVICES, SYSTEMS AND METHODS

(71) Applicant: SCHLUMBERGER TECHNOLOGY CORPORATION, Sugar Land, TX (US)

(72) Inventor: Jonathan Luke James, Gloucester (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 262 days.

(21) Appl. No.: 15/078,059

(22) Filed: Mar. 23, 2016

(65) Prior Publication Data

US 2016/0298418 A1 Oct. 13, 2016

Related U.S. Application Data

(60) Provisional application No. 62/144,303, filed on Apr. 7, 2015.

(51) Int. Cl.
*E21B 34/06* (2006.01)

(52) U.S. Cl.
CPC ..... *E21B 34/066* (2013.01)

(58) Field of Classification Search
None
See application file for complete search history.

(56) References Cited

U.S. PATENT DOCUMENTS 3,309,656 A 3/1967 Godbey
5,375,098 A 12/1994 Malone et al.
6,550,325 B1 * 4/2003 Inushima ..... G01F 1/688 338/225 SD
6,626,253 B2 9/2003 Hahn et al.
7,088,964 B2 * 8/2006 O ..... H01Q 1/38 257/725
8,302,685 B2 11/2012 Reyes et al.
8,708,064 B2 4/2014 Downton et al.
2005/0150691 A1 7/2005 Schultz et al.
2006/0243487 A1 * 11/2006 Turner ..... E21B 7/062 175/26
2014/0116789 A1 * 5/2014 Sue ..... C22C 26/00 175/428
2015/0034165 A1 2/2015 Conn et al.
2015/0034385 A1 2/2015 Kolbe et al.
2015/0034386 A1 2/2015 Reed et al.

OTHER PUBLICATIONS

International Search Report and Written Opinion issued in related PCT application PCT/US2016/024594 dated Jun. 30, 2016, 15 pages.

* cited by examiner

*Primary Examiner* — Shane Bomar

(57) ABSTRACT

An apparatus, device or system according to one or more aspects includes a first-type diamond semiconductor moveably positioned relative to a second-type diamond semiconductor, the first-type diamond semiconductor operationally connected to a tool element, the first-type diamond semiconductor moving relative to the second type diamond semiconductor in response to movement of the tool element, and an electrical signal created in response to the first-type and the second-type diamond semi-conductors moving in and out of contact with one another, where the electrical signal or electrical signals are indicative of a monitored condition.

20 Claims, 4 Drawing Sheets

DIAMOND SWITCHING DEVICES, SYSTEMS AND METHODS

CROSS-REFERENCE TO RELATED APPLICATION(S)

This application claims the benefit of and priority to U.S. Provisional Application Ser. No. 62/144,303, filed Apr. 7, 2015, which is incorporated herein by reference in its entirety.

BACKGROUND

This section provides background information to facilitate a better understanding of the various aspects of the disclosure. It should be understood that the statements in this section of this document are to be read in this light, and not as admissions of prior art.

Wells are generally drilled into the ground to recover natural deposits of hydrocarbons and other desirable materials trapped in geological formations in the Earth's crust. A well is typically drilled using a drill bit attached to the lower end of a drill string. The well is drilled so that it penetrates the subsurface formations containing the trapped materials and the materials can be recovered.

A variety of valves are used to control flow of actuating fluids in many well applications and other flow control applications. For example, valves are employed in wellbore drilling to control the actuation of tools located in the wellbore being drilled. During wellbore drilling operations, valves positioned in the downhole drilling assembly can be actuated to control the direction of drilling. The valves may be positioned, for example to control the flow of drilling mud to actuating pads which are extended and contracted in a controlled manner to steer the drill bit in the desired direction. In some applications a valve, or valve-type member is actuated to repeatedly interrupt the flow of the drilling fluid to cause varying pressure waves to be generated in the drilling fluid at a carrier frequency to provide signal communication between downhole systems and with the surface. It is desired to know the rotational speed of this valve members and whether or not the device has become blocked due to solids in the drilling fluid. Other factors such as wear, breakage, position of the valve member and the like also contribute to the efficiency of the tool.

SUMMARY

An apparatus, device or system in accordance to one or more aspects includes a first-type diamond semiconductor moveably positioned relative to a second-type diamond semi-conductor, the first-type diamond semiconductor is operationally connected to a tool element and the first-type diamond semiconductor moves relative to the second type diamond semiconductor in response to movement of the tool element, and an electrical signal indicative of a monitored condition is created in response to the first-type and the second-type diamond semi-conductors moving in and out of contact with one another. In accordance to an aspect of the disclosure a wellbore system includes a downhole tool having a moveable tool element disposed with a tubular string in a wellbore and a switching device operationally connected with the downhole tool and including a first-type diamond semiconductor moveably positioned relative to a second-type diamond semi-conductor, the first-type diamond semiconductor operationally connected to the tool element such that the first-type diamond semiconductor moves relative to the second type diamond semiconductor in response to movement of the tool element, and an electrical signal is created in response to the first-type and the second-type diamond semi-conductors moving in and out of contact with one another.

A method according to an aspect of the disclosure includes monitoring a condition of a downhole tool disposed in a wellbore, the downhole tool having a first-type diamond semiconductor moveably positioned relative to a second-type diamond semi-conductor and the first-type diamond semiconductor operational connected to a tool element of the downhole tool such that the first-type diamond semiconductor moves relative to the second type diamond semiconductor in response to movement of the tool element; and creating an electrical signal that is indicative to the monitored condition in response to the first-type and the second-type diamond semi-conductors moving in and out of contact with one another.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

Embodiments of diamond switching mechanisms, systems and methods are described with reference to the following figures. The same numbers are used throughout the figures to reference like features and components. It is emphasized that, in accordance with standard practice in the industry, various features are not necessarily drawn to scale. In fact, the dimensions of various features may be arbitrarily increased or reduced for clarity of discussion.

DETAILED DESCRIPTION

Figure 1:
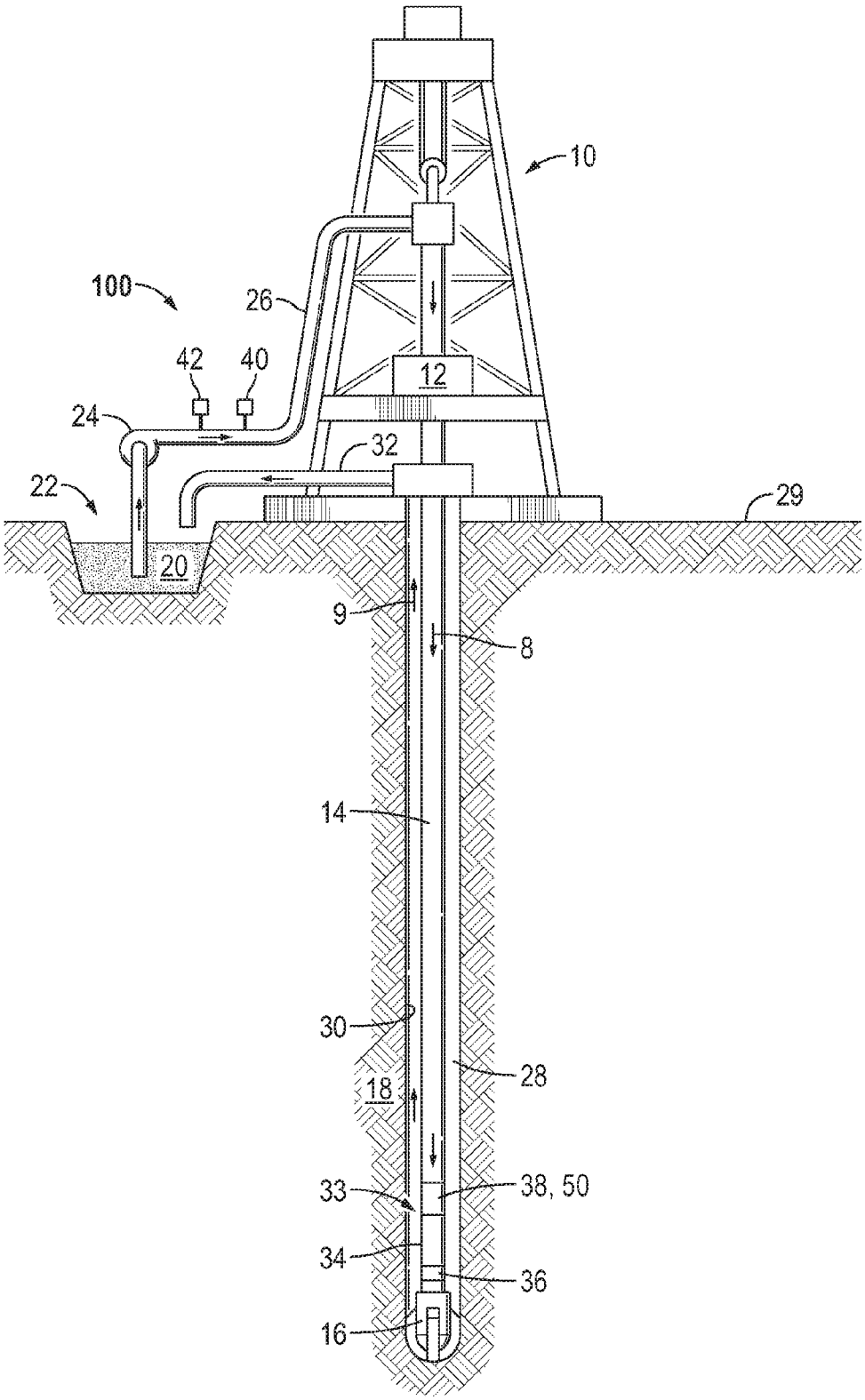
FIGS. 1 and 2 illustrate wellbore systems in which a diamond switching device in accordance to aspects of the disclosure can be implemented.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

Figure 2:
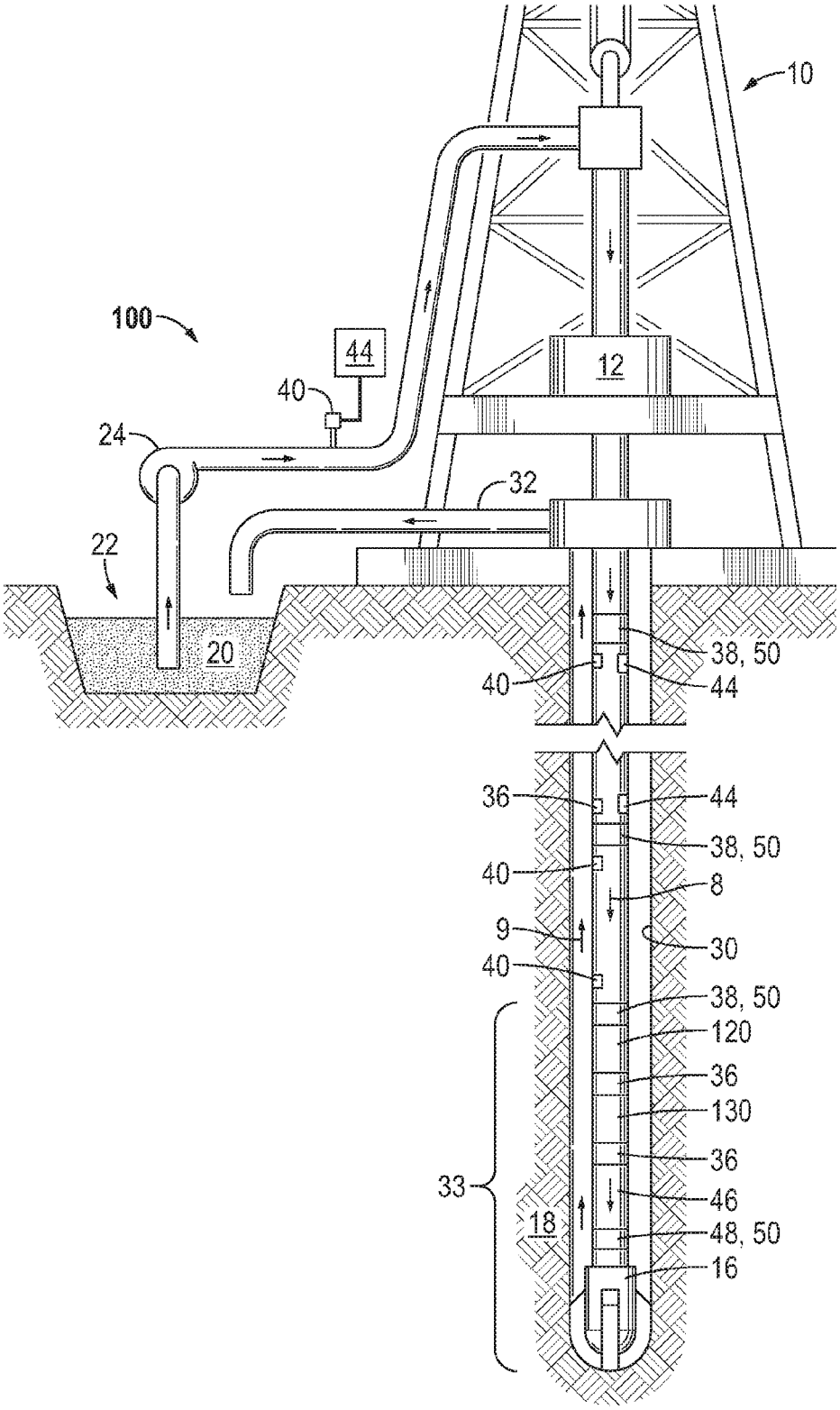

FIGS. 1 and 2 illustrate examples of wellbore systems 100 in which diamond switch, or switching, devices generally denoted by the numeral 50 may be utilized. As will be understood by those with benefit of this disclosure the diamond switching device 50 can also be utilized in non-drilling wellbore systems and non-wellbore systems.

The diamond switching mechanism may be utilized in various tools for example, and without limitation, to monitor the position, orientation and the speed of a device such as rotary or linear valve, to determine potential blockage of a valve, and be utilized as a switch to power and/or control another process or device. By way of example, diamond switching device 50 is illustrated being utilized with a mud pulse telemetry device 38 (e.g., fluidic modulator) in FIGS. 1 and 2 and with a valve of a rotary steering system 48 in FIG. 2. As will be understood by those skilled in the art with benefit of this disclosure, the diamond switching device can be utilized to control and/or monitor the speed or position of devices other than the depicted fluidic modulator and rotary steering system valve.

Wellbore system 100, which may be on-shore or off-shore, is depicted having a drilling rig 10 which includes a drive mechanism 12 to provide a driving torque to a drill string 14. The lower end of the drill string 14 extends into a wellbore 30 and carries a drill bit 16 to drill an underground formation 18. During drilling operations, drilling fluid 20 is drawn from a mud pit 22 at a surface 29 via one or more pumps 24, such as, for example, one or more reciprocating pumps. The drilling fluid 20 is circulated through a mud line 26 down through the drill string 14 as indicated by the directional arrow 8, through the drill bit 16, and back to the surface 29 via an annulus 28 between the drill string 14 and the wall of the wellbore 30 as indicated by the direction arrow 9. Upon reaching the surface 29, the drilling fluid 20 is discharged through a line 32 into the mud pit 22 so that drill cuttings, such as, for example, rock and/or other well debris carried uphole in the drilling mud can settle to the bottom of the mud pit 22 before the drilling fluid 20 is recirculated into the drill string 14.

Drill string 14 includes a bottom hole assembly ("BHA") 33, which includes at least one downhole tool 34. Downhole tool 34 may comprise survey or measurement tools, such as, logging-while-drilling ("LWD") tools, measuring-while-drilling ("MWD") tools, near-bit tools, on-bit tools, and/or wireline configurable tools. LWD tools may include capabilities for measuring, processing, and storing information, as well as for communicating with surface equipment. Additionally, LWD tools may include one or more of the following types of logging devices that measure characteristics associated with the formation 18 and/or the wellbore: a resistivity measuring device; a directional resistivity measuring device; a sonic measuring device; a nuclear measuring device; a nuclear magnetic resonance measuring device; a pressure measuring device; a seismic measuring device; an imaging device; a formation sampling device; a natural gamma ray device; a density and photoelectric index device; a neutron porosity device; and a borehole caliper device. A LWD tool is identified specifically with the reference number 120 in FIG. 2.

MWD tools may include for example one or more devices for measuring characteristics adjacent drill bit 16. MWD tools may include one or more of the following types of measuring devices: a weight-on-bit measuring device; a torque measuring device; a vibration measuring device; a shock measuring device; a stick slip measuring device; a direction measuring device; an inclination measuring device; a natural gamma ray device; a directional survey device; a tool face device; a borehole pressure device; and a temperature device. MWD tools may detect, collect and/or log data and/or information about the conditions at the drill bit 16, around the underground formation 18, at a front of the drill string 14 and/or at a distance around the drill strings 14. A MWD tool is identified with the reference number 130 in FIG. 2.

Downhole tool 34 may comprise a downhole power source, for example, a battery, downhole motor, turbine, a downhole mud motor or any other power generating source. The power source may produce and generate electrical power or electrical energy to be distributed throughout the BHA 33 and/or to power the at least one downhole tool 34.

The downhole tool 34 depicted in FIG. 1 includes a sensor 36, e.g., sensor assembly, data source, and a fluidic modulator 38 for mud pulse telemetry in accordance to one or more aspects of this disclosure. Fluidic modulator 38 is operated to disrupt the flow of the drilling fluid 20 through the drill string 14 to cause pressure pulses or changes fluid flow. The pressure pulses are modulated by operation of the fluidic modulator and thereby encoded for telemetry purposes. System 100 depicted in FIG. 2 includes more than one fluidic modulator 38 each of which may be utilized to modulate pressure pulses in the drilling fluid 20 to transmit data (e.g., control signals) downhole and/or to transmit downhole measurements to the surface. In accordance to aspects of the disclosure the flow path through the fluidic modulator 38 is co-axial with the flow path through the drill string. The fluidic modulator 38 is operated so as to create a pressure change in the drilling fluid in the wellbore and in the mud line 26 that is encoded with data for example from the downhole data source 36. The modulated changes in the pressure of the drilling fluid 20 may be detected at the surface by a pressure transducer 40 and/or a pump piston sensor 42, both of which may be coupled to a processor 44 located at the surface (FIG. 2). The fluidic modulators 38 may be associated downhole with processor 44 as well, see e.g. FIG. 2. The processors 44 may interpret the modulated changes in the pressure of drilling fluid 20 to reconstruct the measurements, data and/or information collected at the sensors 36 and sent by the fluidic modulators. The processor 44 may also encode data such that the fluidic modulator is actuated to modulate the pressure pulses to transit the encoded data. The processor 44 may be utilized as a controller to operate the position of the valve or tool element. The modulation and demodulation of a pressure wave are described in detail in commonly assigned U.S. Pat. Nos. 5,375,098 and 8,302,685, which are incorporated by reference herein in their entirety. In accordance to aspects of the disclosure the fluidic modulators 38 may incorporate or be operationally connected with a diamond switching device 50 which may be utilized to monitor the position, condition and/or speed of the operational member (tool element) of the fluidic modulator 38 and/or to control or operate the fluidic modulator.

FIG. 2 illustrates a BHA 33 including a drilling motor 46 (e.g., mud motor), a rotary steering system ("RSS") 48 and drill bit 16. In accordance with some embodiments, drilling motor 46 converts fluid power in the downward mud flow into rotary motion. The rotary motion is transmitted to the portions of the BHA below mud motor 46. The drilling motor 46 may comprise a positive displacement motor ("PDM") or turbodrill. FIG. 2 illustrates a rotary steering system ("RSS") 48 connected below the drilling motor 46. As illustrated for example in FIG. 6, RSS 48 includes pads that are selectively actuated by hydraulic fluid and a rotary valve to steer the drill bit. In accordance to one or more aspects, a diamond switching device 50 is operationally connected with the rotary steering system.

Many rotary steerable drilling tools operate using a reciprocating motion valve to divert mud flow, be it rotary or linear, see, e.g., U.S. Pat. No. 8,708,064, the teachings of which are incorporated herein. When a rotary steerable tool is being used it is vital to know the RPM of the valve and whether or not it has become blocked due to solids in the mud. Many other factors such as wear, breakage, position of the valve etc. contribute to the efficiency of the tool.

A means of monitoring the RPM, position, orientation of a valve or whether it has been blocked is problematic due to the harsh environment the valve operates in. Many sensors that could be used to measure these criteria cannot operate in mud, high pressure, temperature or abrasives. A function of synthetic diamond is that it can be doped with either boron or phosphorus to make it behave as a p-type or n-type semiconductor respectively. By using a pair of these doped diamonds a diode type switching mechanism can be made. If three of these switching mechanisms 50 were to be used a transistor could effectively be made.

Figure 3:
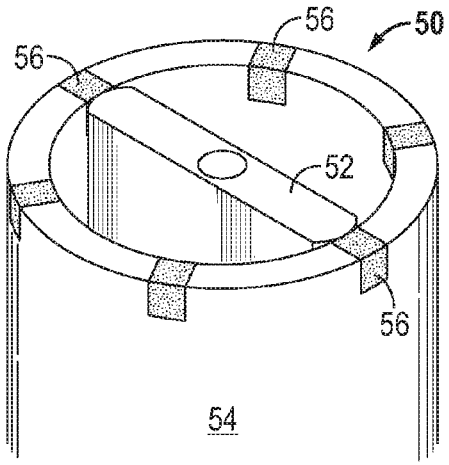
FIG. 3 is a schematic illustration of a diamond switching device in accordance with one or more embodiments.

FIG. 3 schematically illustrates diamond switching mechanism, generally denoted with the numeral 50, in accordance to one or more aspects of the disclosure. A rotor tab 52 may be made from diamond doped, for example, with boron. The illustrated rotor tab 52 may be connected to a moveable tool member, for example a valve member, a drive shaft or the like, such that rotor tab 52 moves with the moveable tool member. In the illustrated example, rotor tab 52 is an n-type diamond semiconductor. Electrical contact could be made for example through the bottom of the rotor tab via a slip ring or bearing arrangement. Rotor tab 52 is positioned so as to rotate freely relative to a stator 54, e.g., cylinder, made of a non-conductive material, such as tungsten carbide (WC) or non-doped diamond (e.g., polycrystalline diamond). A disc or stator tab 56 of, for example, phosphorus doped diamond may be set into the wall of the stator 54 in line vertically with the rotor tab 52. In the illustrated example, the stator tab 56 is a p-type semiconductor. One or more stator tabs 56 may be positioned circumferentially and/or vertically along the stator. In some embodiments, the clearance between the rotor tab 52 and the stator tab 56 is such that they contact as the rotor rotates.

In use an electrical current is applied to the rotor tab 52. When the rotor tabs 52 and stator 56 are not in contact the circuit is broken. When the rotor tab 52 and the stator tab 56 are in contact the circuit is closed and a signal of some description is created. One or more tabs could be placed in the cylinder and the rotor to allow for additional signal and functionality, such as creating a transistor. This methodology could be applied both to a fully rotating rotor, an oscillating rotor or linear valve or any number of other designs. Through processing these signals it is possible to determine the speed of the valve (RPMs), position of the valve (which could be increased by adding more than 1 tab) and potential blockage of the valve. It could also be used as a switch to power/control another process or device or any number of other actions.

In accordance to an aspect, the diamond switching device, or mechanism, 50 is utilized to control or monitor the speed or position of a valve member or other moveable element of a downhole tool such as a fluidic modulator 38 in a similar manner as discussed above. Examples of fluidic modulators include without limitation a rotary valve or "mud siren" pressure pulse generator, for example disclosed in U.S. Pat. No. 3,309,656, oscillating valve designs such as disclosed in U.S. Pat. No. 6,626,253, and moveable element pressure pulse generators such as those disclosed in US Publ. Nos. 2015/0034165 A1, 2015/0034385 A1, and 2015/0034386 A1, all of which are incorporated by reference herein in their entireties. The diamond switching mechanism may be used in aggressive environment without sealing a fragile sensor.

Figure 4:
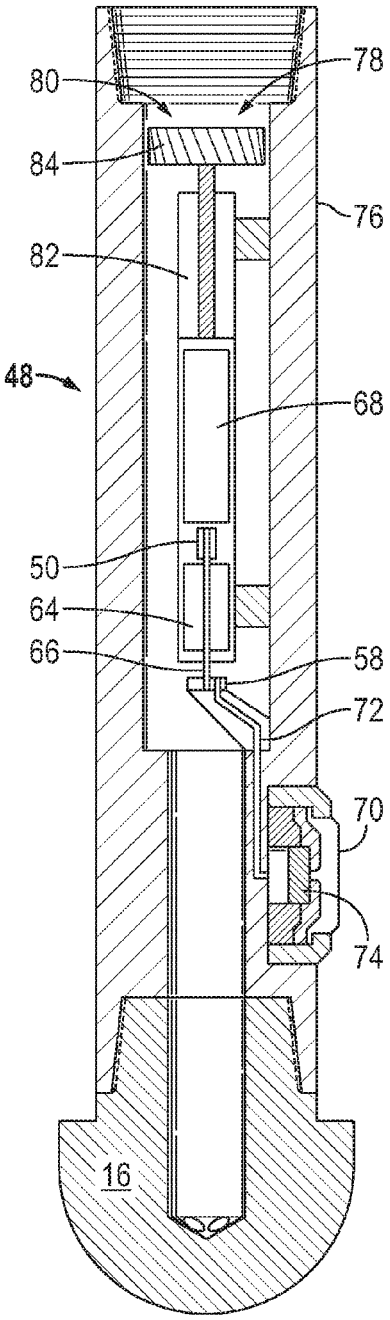
FIGS. 4 and 5 illustrate a diamond switching device utilized with a rotary valve in a downhole drilling tool in accordance to one or more aspects of the disclosure.
Figure 5:
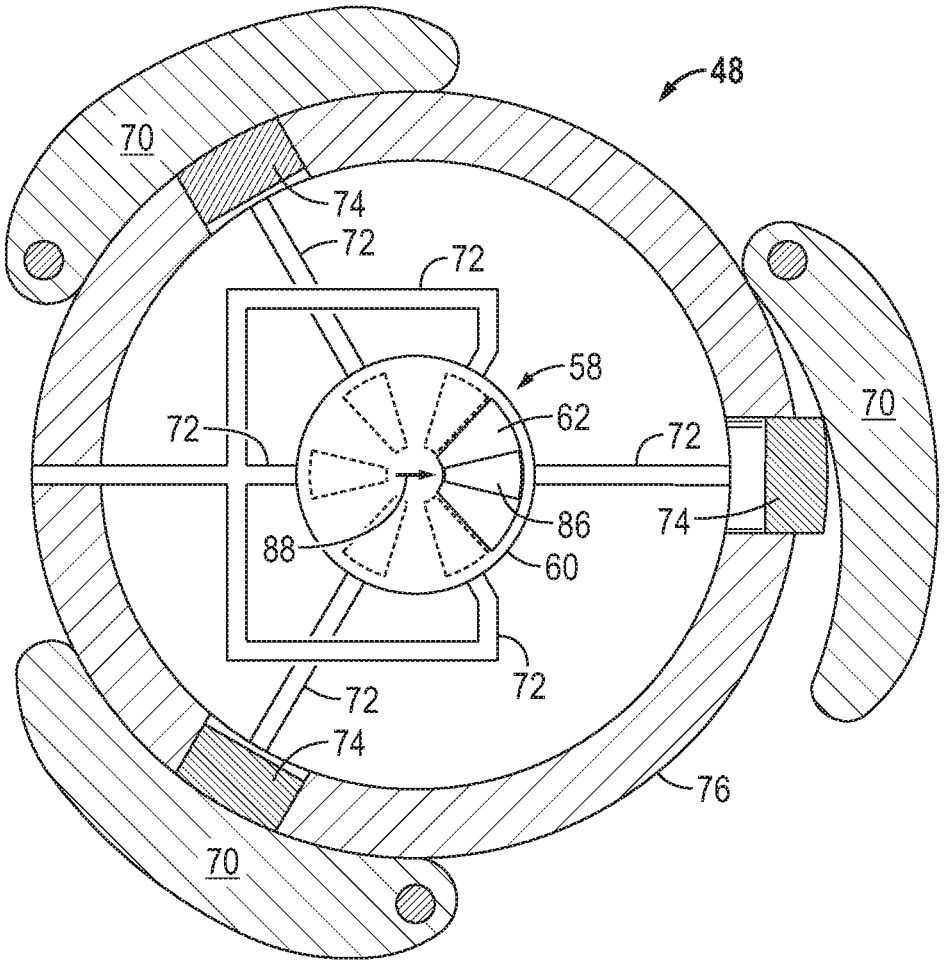

FIGS. 4 and 5 illustrate an example of a diamond switching device 50 operationally connected to a rotational valve 58 utilized in a rotary steerable system 48. The rotary valve 58 may be selectively rotated to enable flow of fluid (i.e., drilling fluid) and/or to block the flow of the fluid with respect to steering pads 70. For example, the drilling fluid 20 (FIG. 2) may be delivered through hydraulic lines 72 to act against pistons 74. During rotation of the drill collar 76 and drill bit 16 for drilling a wellbore, the rotary valve 58 undergoes a controlled, rotation relative to the drill collar to ensure either delivery of the drilling fluid through the hydraulic line 72 to the desired steering pad or blockage of the drilling fluid to the steering pad. As the drill collar rotates, the valve 58 is able to selectively open or shut off pads by allowing the drilling fluid to enter the selected hydraulic lines which correspond to selected pads. Additionally, the rotary valve may be selectively rotated to control other functions, e.g., telemetry functions downhole. For example, the rotary valve 58 may be controlled to cause pressure pulses in the drilling fluid. In some applications, the valve 58 may be used to control other functions unrelated to directional steering.

The valve 58 (e.g., spider valve) is mounted to a drive shaft 66 in this example which is rotated by an actuator 64, such as an electric motor. The drive shaft 66 rotates the member 60, e.g. tool element, relative to member 62 to open, close or otherwise alter opening 86. A diamond switching device 50 is operatively engaged with the drive shaft 66 to monitor the angular orientation, shown by the arrow 88 in FIG. 5, for example relative to the drill collar. The system includes a controller 68 (i.e. processor, electronics). The controller 68 receive data from the diamond switching device 50 and uses the data to control the actuator 64 which, in turn, controls the angular positioning of the rotary valve 58. Electric power may be provided to the controller 68, actuator 64, and to other components via a suitable power source 78. By way of example, the power source 78 may comprise batteries and/or a turbine 80. The turbine 80 may comprise an alternator 82 driven by rotation of turbine blades 84 which are rotated by the pressurized flow of the drilling fluid down through the RSS and the drill bit 16.

Although a few example embodiments have been described in detail above, those skilled in the art will readily appreciate that many modifications are possible in the example embodiments without materially departing from the disclosure. Additionally, it should be understood that references to "one embodiment" or "an embodiment" of the present disclosure are not intended to be interpreted as excluding the existence of additional embodiments that also incorporate the recited features. For example, features shown in individual embodiments referred to above may be used together in combinations other than those which have been shown and described specifically. Accordingly, any such modification is intended to be included within the scope of this disclosure. In the claims, means-plus-function clauses are intended to cover the structures described herein as performing the recited function and not just structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke means-plus-function for any limitations of any of the claims herein, except for those in which the claim expressly uses the words 'means for' together with an associated function.

What is claimed is:

1. An apparatus, comprising:

a first-type diamond semiconductor moveably positioned relative to a second-type diamond semiconductor;

the first-type diamond semiconductor operationally connected to a tool element, the first-type diamond semiconductor moving relative to the second type diamond semiconductor in response to movement of the tool element; and an electrical signal created in response to the first-type and the second-type diamond semi-conductors moving in and out of contact with one another, the electrical signal being indicative of a monitored condition.

2. The apparatus of claim 1, wherein the tool element is a valve member.

3. The apparatus of claim 1, wherein the monitored condition is a position of a valve and the tool element is a movable element of the valve.

4. The apparatus of claim 1, wherein the tool element is a valve member of one of a rotary valve, an oscillating valve, and a poppet valve.

5. The apparatus of claim 4, wherein the monitored condition is a valve position.

6. The apparatus of claim 1, wherein the tool element is a valve member of a rotary valve.

7. The apparatus of claim 1, wherein the tool element is a drive shaft.

8. The apparatus of claim 1, wherein the tool element is a moveable element of a fluidic modulator.

9. The apparatus of claim 1, wherein the tool element is a valve in communication with a hydraulic line of a rotary steerable system.

10. A wellbore system, the comprising:

a downhole tool having a moveable tool element disposed with a tubular string in a wellbore; and a switching device operationally connected with the downhole tool, the switching device comprising:

a first-type diamond semiconductor moveably positioned relative to a second-type diamond semiconductor;

the first-type diamond semiconductor operationally connected to the tool element, the first-type diamond semiconductor moving relative to the second type diamond semiconductor in response to movement of the tool element; and an electrical signal created in response to the first-type and the second-type diamond semi-conductors moving in and out of contact with one another, the electrical signal being indicative of a monitored condition.

11. The system of claim 10, wherein the downhole tool is a valve.

12. The system of claim 11, wherein the valve is one of a rotary valve, an oscillating valve, and a poppet valve.

13. The system of claim 10, wherein the monitored condition is one position and speed.

14. The system of claim 10, wherein the downhole tool is a fluidic modulator.

15. The system of claim 14, further comprising an actuator connected to the tool element and a processor connected to the actuator and the switching device.

16. The system of claim 10, wherein the downhole tool is a valve to selectively control the flow of a fluid to a steering pad.

17. The system of claim 16, wherein the monitored condition is one of valve position and speed of movement.

18. A method, comprising:

monitoring a condition of a downhole tool disposed in a wellbore, the downhole tool comprising a first-type diamond semiconductor moveably positioned relative to a second-type diamond semi-conductor and the first-type diamond semiconductor is operationally connected to a tool element of the downhole tool, the first-type diamond semiconductor moving relative to the second-type diamond semiconductor in response to movement of the tool element; and creating an electrical signal indicative of the monitored condition in response to the first-type and the second-type diamond semi-conductors moving in and out of contact with one another.

19. The method of claim 18, wherein the downhole tool is a valve selectively controlling the application of fluid to a steering pad of a rotary steerable system.

20. The method of claim 18, wherein the downhole tool is a fluidic modulator, and further comprising operating the fluidic modulator to create signal encoded pressure pulses in a fluid disposed in the wellbore.

* * * * *